United States Patent [19]

Al-Chalabi

[11] Patent Number: 4,784,677

[45] Date of Patent: Nov. 15, 1988

[54] PROCESS AND APPARATUS FOR CONTROLLING ARGON COLUMN FEEDSTREAMS

[75] Inventor: Ismael Al-Chalabi, Westfield, N.J.

[73] Assignee: The BOC Group, Inc., Montvale, N.J.

[21] Appl. No.: 74,402

[22] Filed: Jul. 16, 1987

[51] Int. Cl.[4] ..... F25J 3/00

[52] U.S. Cl. ..... 62/37; 23/293 R

[58] Field of Search ..... 62/21, 22, 37; 23/254 E

[56] References Cited

U.S. PATENT DOCUMENTS

| | | | |
|---|---|---|---|
| 2,764,536 | 9/1956 | Hutchins | 62/37 |
| 2,792,501 | 5/1957 | Barton, Jr. | 62/37 |
| 2,794,924 | 6/1957 | Skarstrom | 62/37 |
| 2,882,693 | 4/1959 | Clay | 62/37 |
| 2,885,863 | 5/1959 | Berger | 62/37 |
| 2,934,907 | 5/1960 | Scofield | 62/21 |
| 2,934,908 | 5/1960 | Latimer | 62/22 |
| 3,259,554 | 7/1966 | Constantikes | 62/37 |
| 3,401,092 | 9/1968 | Matta | 62/21 |
| 3,420,748 | 1/1969 | Johnson et al. | 62/37 |
| 3,619,377 | 11/1971 | Palmer et al. | 62/37 |
| 3,742,721 | 7/1973 | Bourguet et al. | 62/37 |
| 3,912,476 | 10/1975 | Mikawa et al. | 62/21 |
| 3,951,607 | 4/1976 | Fraser | 23/254 E |
| 3,996,010 | 12/1976 | Fraser | 23/254 E |

*Primary Examiner*—Ronald C. Capossela

*Attorney, Agent, or Firm*—R. Hain Swope; Chris P. Konkol; Larry R. Cassett

[57] ABSTRACT

The present invention relates to methods and apparatus for controlling a process for the separation of air to obtain oxygen, argon, and nitrogen products, and more particularly for controlling the composition of the feedstream to a column for producing crude argon. The nitrogen content of the feedstream is directly analyzed in real time and maintained within a preselected range. The results of the analysis is used to control the operation of the process, for example, by adjusting the reflux or product withdrawal rates. Argon production is thereby maximized without risking a dumping phenomenon in the crude argon column.

32 Claims, 5 Drawing Sheets

PROCESS AND APPARATUS FOR CONTROLLING ARGON COLUMN FEEDSTREAMS

BACKGROUND OF THE INVENTION

The present invention relates to an improvement in the process and apparatus for controlling the separation of air to obtain oxygen, argon, and nitrogen products and, more particularly, for controlling the composition of the feedstream to a crude argon column. Such a feedstream composition is a crucial parameter in the crude argon production process. The nitrogen content of the feedstream which can change rapidly affects the stability of the process.

The crude argon column feedstream is customarily taken from the low pressure column of an Air Separation Unit (ASU) at a point which is in the vicinity of the peak argon concentration. This region is termed the argon band. A typical feedstream composition is about 100 ppm nitrogen and 10% argon with the balance of oxygen. However, actual compositions depend on the particular plant design and how it is being operated. Maintaining the correct level of nitrogen in the feedstream to the crude argon column is however very important for the following reasons:

(1) If the nitrogen concentration is too high, the nitrogen pressure in the top product of the crude argon column will have a detrimental effect on the heat transfer duty of the argon condensor which in turn will negatively affect the flow of gas up the column. At some stage the gas flow will drop below that needed to properly support the liquid on the trays and the liquid will flow out of the trays towards the bottom of the column. This is known as dumping the column. Dumping the column leads to a loss in argon production and a serious dump could require about a day for recovery. Moreover, the liquid oxygen product in the low pressure column of the ASU can become contaminated with dumped argon liquid.

(2) If the nitrogen concentration is too low, this implies that the argon band is relatively high in the low pressure column of the ASU and more argon is being vented with the waste nitrogen. The result is that the argon recovery is not maximized. As a minimum liability, more energy is being expended for the recovery of argon than is necessary.

For a given situation, there is an optimum nitrogen concentration in the feedstream to the crude argon column corresponding to maximum argon recovery. However, since the argon band happens to be located in the tail of a steep nitrogen concentration gradient, the amount of nitrogen in the feedstream can vary rapidly from the tens of ppm to thousands of ppm in response to relatively small changes in the plant, while on a percentage basis the corresponding variations in argon concentration, though important with respect to the argon recovery rate, may be comparatively small.

If the feedstream nitrogen levels could be maintained closer to the optimum level, the average argon production rates could be significantly increased. An improvement in argon production of about ten percent is possible using the present invention.

The composition of the feedstream to the crude argon column in a typical air separation plant is a sidestream going from the low pressure column of the ASU to the crude argon column. This composition may be affected and controlled by oxygen product withdrawal rates. For instance, if the oxygen withdrawal rate is increased, then the argon band will be shifted down the column resulting in an increase in the argon and nitrogen concentration in the feedstream to the crude argon column. The inverse situation will occur if the oxygen withdrawal rate is decreased. Since the former situation is less desirable than the latter situation, the tendency is to operate a plant conservatively, or in other words, sufficiently far away from the dumping condition so that the approach of a dumping condition can be noticed and corrected in time to avoid a significant dump. The approach of a dumping condition may be signaled by an increase in the nitrogen in the crude argon product stream of the crude argon column and a decline in the pressure differential across the trays in the crude argon distillation column. Since the process is typically controlled manually, considerable skill and experience is required to achieve consistently high rates of argon production.

Prior art control techniques have been unsatisfactory. For example, as one basis of control, the argon and oxygen concentratios in the crude argon product were monitored, whereupon the amount of nitrogen (which is the balance) was given by the difference. The nitrogen concentration at this point is about one or two percent, whereas the nitrogen concentration in the feed gas to the crude argon column is typically in the hundreds of parts per million. This difference is due to the fact that the nitrogen tends to be concentrated along with the argon. However, monitoring the process by monitoring the nitrogen in the product is like measuring the accumulated effect of a control error rather than the control error itself.

Other past techniques for indirectly controlling the nitrogen concentration in the sidearm feedstream to the crude argon column include measuring a change in pressure or by monitoring temperature levels on certain trays and adjusting production rates of argon withdrawn from the auxillary rectification tower (the crude argon column), such as disclosed in U.S. Pat. No. 2,934,908 to Latimer, or by adjusting the reflux to the primary rectification unit (the low pressure column of the ASU), similarly in response to temperature levels, such as disclosed in U.S. Pat. No. 2,934,907 to Scofield. Such adjustments to process conditions, however, suffer from either insensitivities or delays in response to sensed conditions inherent in the operation of the rectification process.

Another previous control technique involved measuring the percent of oxygen in the feedstream to the crude argon column, thereby inferring the nitrogen concentration. When the oxygen decreased, it was generally inferred that the nitrogen had increased. However, the nitrogen versus argon concentration could not be determined. The system was controlled normally by the oxygen withdrawal rate. However, this control scheme presented certain drawbacks. In particular, if argon was building up, the correct response would be to draw more argon out of the crude argon column. Instead, the analyzer might cut off the argon product, by incorrectly inferring build up of nitrogen. Furthermore, this control was not sufficiently sensitive and too slow. As a result of the state of the art, the process was run conservatively, thereby not optimizing argon production.

BRIEF SUMMARY OF THE INVENTION

In contrast to the above described techniques, the present invention measures nitrogen in the crude argon feedstream directly, thereby eliminating false responses and ensuring correct action. Ample response time is provided to effect control of the system so that the argon content in the feedstream to the crude argon column can be maximized. More efficacious operation of the entire process is achieved by maintaining the nitrogen content within a desired range, e.g. 20 to 2000 parts per million (ppm). In particular, direct analysis of the nitrogen content is achieved by the use of a "continuous real-time" analyzer with a response time of under 5 minutes, and preferably under 1 second.

OBJECTS OF THE INVENTION

It is therefore an object of the present invention to maximize argon production without risking a crude argon column dump.

It is a further object of the invention to protect the crude argon column from transient disturbances by providing advance warning of up to 30 minutes.

It is yet a further object of the present invention to achieve quality control of the feed to the crude argon column.

It is yet a further object of the present invention to accomplish multivariable control of the low pressure column of an Air Separation Unit (ASU) including monitoring the parameters of an on-line real time analyzer.

It is yet a further object of the present invention to maintain the nitrogen content of the crude argon column product within certain specifications.

Other objects of the present invention will become apparent from the following description of an exemplary embodiment thereof which follows and the novel features will be particularly pointe out in conjunction with claims appended hereto.

DETAILED DESCRIPTION OF THE INVENTION

The present invention will be described in connection with the apparatus of FIG. 1 which, as well understood by those skilled in the art, includes various means suitable for the separation of air to obtain an oxygen and/or nitrogen product substantially free of impurities and a product having a high content of argon. However, modifications within the scope of the invention may be made to the various air separation means if it is so desired. One of ordinary skill in the art will recognize that the present control method is applicable in general to low temperature rectification plants for the simultaneous production of oxygen and nitrogen, in either gaseous or liquid form, along with argon.

Figure 1:
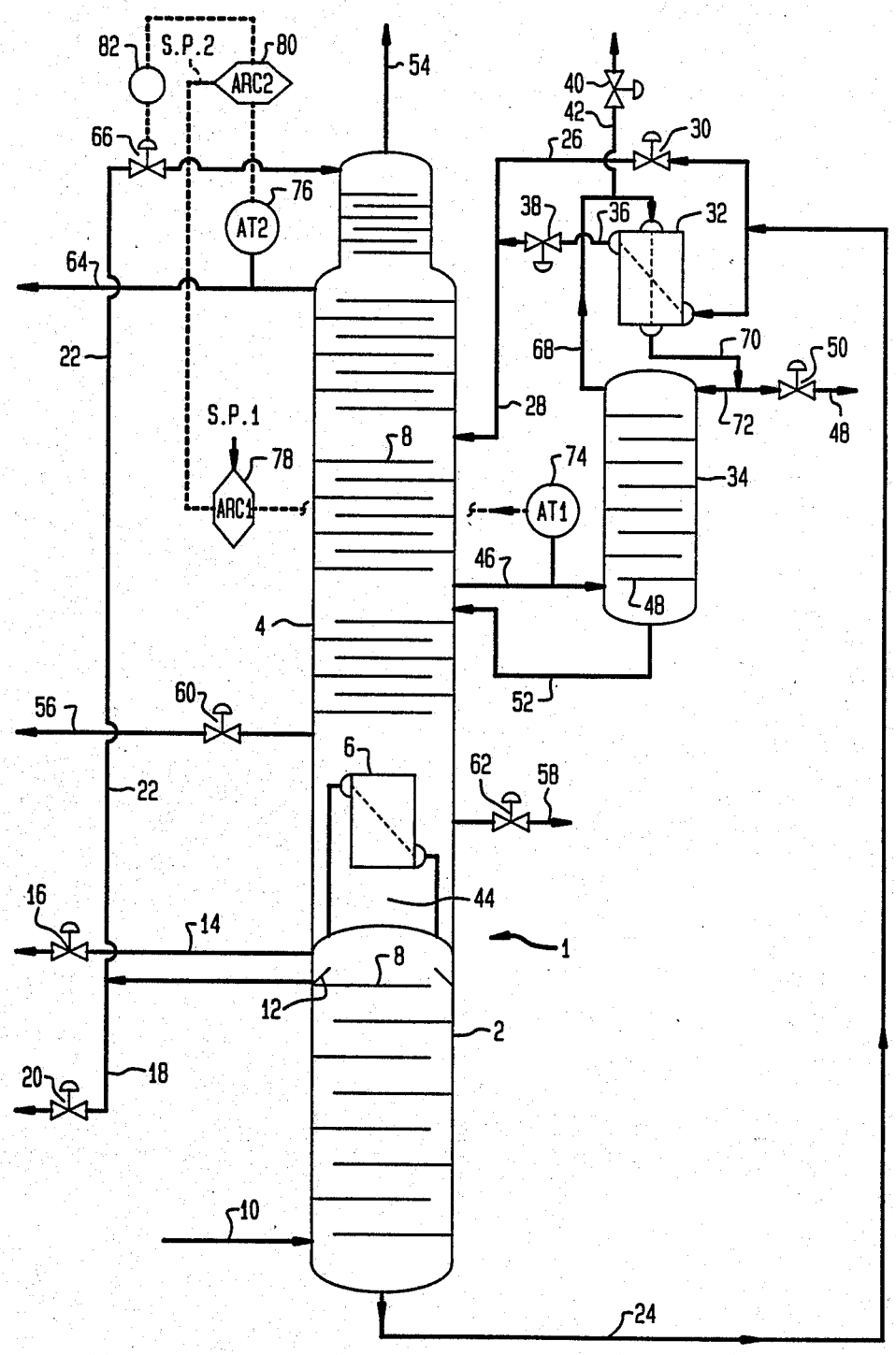
FIG. 1 shows in conventional diagrammatic form an air separation apparatus illustrating the principles of the improved process as applied to a plant wherein an argon fraction, a substantially pure liquid nitrogen fraction, and a substantially pure liquid oxygen fraction are produced.

Referring now to FIG. 1 of the drawings, the air rectifying apparatus 1 is of conventional construction and typically includes a double column, having the usual high pressure stage or lower column 2, a low pressure stage or upper column 4 extending above the lower column, and a condenser 6 disposed between the two columns. The high and low pressure columns may contain customary column trays, such as perforated plates 8 which affect intimate contact between vapors rising in the column and reflux liquid flowing down the column.

Air cooled to near its saturation or dew point and cleaned of contaminants such as carbon dioxide and water is fed under compression into the bottom part of the lower column 2 through a conduit 10. This air is subjected to an initial rectification whereby an oxygen rich liquid fraction is produced that accumulates at the base of the lower column 2 and a substantially pure nitrogen gaseous fraction is produced at the top of the lower column. The nitrogen rich gas enters the condenser 6 and is condensed, the condensed fraction falling back into the lower column 2 where part is received on an annular shelf 12 and part overflows onto the top trays to serve as reflux liquid for the lower column 2. The balance of the nitrogen gas which does not enter the condenser can be drawn off as desired through conduit 14 by operation of a control valve 16. This nitrogen rich gas is of high purity and may be used directly for such applications as blanketing in steel processing.

The condensed nitrogen falling from said condenser 6 onto an annular shelf 12 is of high purity and may be withdrawn and split into two streams. A first stream through conduit 18 and valve 20 provides high purity liquid nitrogen for storage. A second stream in conduit 22 provides reflux necessary to effect separation of the crude liquid oxygen in the upper column 4, as explained more fully below.

The oxygen enriched liquid that accumulates at the base of the lower column 2 may be withdrawn through a conduit 24 and subsequently split, a portion being introduced into the upper column via conduits 26 and 28 controlled by throttling valve 30 and the remainder being passed to one side of a heat exchanger serving as a crude argon condenser 32 in the top part of a crude argon column 34. The oxygen rich liquid entering the other side of said condenser is vaporized against the condensing argon emanating from the crude argon column and passed through an exit conduit 36 where, via valve 38, it rejoins the stream in conduit 26 to form a combined stream in conduit 28 which enters the upper column 4 and constitutes the main feed to the upper column for further rectification.

Referring now in particular to the operation of the upper (low pressure) column 4, the bottom of the upper column 4 includes liquid oxygen collecting section 44, wherein boiling of part of the liquid oxygen collected therein is effected by the condenser 6 so as to produce vapor for the rectifying action in said upper column. As explained previously, said boiling occurs by heat exchange with the vapor nitrogen emanating from the top of the lower (high pressure) column 2.

The oxygen boils at the low pressure of the upper column 4 at a temperature which is lower than the condensing temperature of the nitrogen in the condenser which is under the pressure of the lower column 2.

At an intermediate point of the upper column 4 where the vapor has a relatively high content of argon and a relatively low content of nitrogen, a vapor outlet conduit 46 conducts argon containing vapor into a lower part of the crude argon column 34. This column has gas and liquid contact means such as trays 48. The argon containing vapor passes upwardly through the column 34 and is washed with a reflux liquid produced by condensation of the rising vapors in crude argon condenser 32 at the top of the column. The vapors passing through the internal space of condenser 32 are subjected to liquefaction, the liquid produced being rich in argon and forming a suitable reflux liquid for washing down the oxygen out of the rising vapor in the column. The balance of the liquid argon may be withdrawn through a conduit 48 that is provided with a control valve 50. The composition or oxygen content of his product is controlled by the amount drawn. The more product withdrawn, the higher the oxygen content. The liquid which accumulates at the bottom of the crude argon column 34 is substantially reduced in its argon content and substantially enriched in oxygen and is preferably returned by a conduit 52 to the upper column 4 of the air separation unit, being admitted at a point near the argon take off.

The low pressure column 4 produces low pressure oxygen and nitrogen. Pure nitrogen (typically about 0.3 ppm) is produced at the top via conduit 54. Gaseous oxygen and liquid oxygen is produced near the bottom and exit through conduits 56 and 58 via valves 60 and 62, respectively. Waste nitrogen stream in conduit 64 typically has an oxygen content of about two percent or less oxygen. This stream may be used, for example, for applications such as the regeneration of the molecular sieve material of the pressure swing adsorption unit used for removing contaminants such as water and carbon dioxide from the air feed to the lower column 2.

The reflux liquid in conduit 22 is principally used to wash oxygen and argon from the rising vapor. The refluxing liquid achieves this purpose while at the same time advantageously positioning an argon band for subsequent enrichment by regulation of valve 66, which controls the rate of transfer of pure nitrogen liquid collected on shelf 12 to the upper column 4.

Enhancement of the wash-out of argon from the rising vapor is provided by proper location of the conduit 28 which introduces oxygen-enriched liquid vapor.

The feedstream to the crude argon column 34 is a gas stream taken from the low pressure column 4 of the air separation unit (ASU) below conduit 28 at a point where the argon concentration is high. The other major gas component of the feedstream is oxygen. The argon is separated from the oxygen in the crude argon column to produce crude argon top product stream in conduit 48. Crude argon typically consists of 96–98% Ar, 1–2% $N_2$ and 1–2% $O_2$. Pure argon may be produced via further conventional processing (not shown) of the crude argon and is typically 99.99+% pure.

The region of high argon concentration in the low pressure column 4 is relatively narrow and is referred to as the "argon band". The concentration of oxygen increases down the column. Depending on the plant and how it is operated, the composition of the feed to the argon column, known as the sidearm feed composition may range from about 0 to 10,000 ppm $N_2$ and 4–20% Ar with the balance being oxygen.

The bottoms stream 52 of the crude argon column 34 is oxygen rich. The gas at the top of the crude argon column 34 enters the condenser 32, suitably through a conduit 68, and is condensed therein. The condensed liquid stream in conduit 70 is split into the previously mentioned top product stream exiting through conduit 48 and reflux stream returning to the crude argon column 34 via conduit 72. It will be understood that, as in other instances, although the crude argon product is withdrawn as a liquid in the present embodiment, the product may alternately be withdrawn as a gas, as in a normal distillation column where merely the reflux is condensed.

The oxygen rich bottoms in conduit 46 is returned to the low pressure column 4 below the crude argon withdrawal point.

The above described air separation system with crude argon auxillary column is the industry workhorse, so to speak. However, other modifications and refinements as will be evident to those of ordinary skill in the air separation art may also be incorporated while practicing the invention herein described.

Referring now to the control system embodiment of FIG. 1, a first controller 78 provides a signal based on the nitrogen content of feedstream 46. This signal enters a second controller 80 which also receives a signal based on the oxygen content of waste stream 64. This second controller in turn adjusts the reflux flow rate entering the upper colum 4 via conduit 22 by activation of valve 66. Alternatively, the signal could be used to adjust a set point of a flow controller on conduit 22 by operation of valve 66. In the parlance of process control engineers, the first controller 78 is the master or primary controller and the second controller 80 is the slave or secondary controller and the combined system is commonly referred to as a cascade system.

At constant overhead flow in conduit 54 and constant reflux composition in conduit 22, the composition (oxygen content) of the nitrogen waste stream is fixed and the reflux flow rate in the upper column is fixed. In other words, the upper column composition profile, also called an operating line, is fixed. A change in the reflux flow will change the oxygen content, since increased reflux would scrub down more oxygen and reduce the oxygen content (and vice versa).

In the event of a change of the vapor flow rate up the upper column 4 or a charge in the oomposition or flow of feedstream 28 (for example, due to a disturbance in the lower column or a change in the heat in-leaked into the upper or lower column), then the second controller will detect a change by measuring the concentration of the waste product (oxygen), which is typically at about 0.03 percent oxygen. The second controller will maintain that operating line in the upper column by adjusting valve 66 to control the reflux ratio. Whereastthe first controller (also called the RETINA controller) will determine where that operating line should be in the upper column.

Assuming prescribed general column conditions prevail, locating the argon band most advantageously is subject to original design of hardware, changes in tray efficiency with air flow, the reflux (RF) to feed (RL) split, and the accuracy of the measurements and the control apparatus programmed to operate the plant.

The composition and the flow of the oxygen enriched liquid 24 is maintained through adjustment of the stream in conduit 18 (liquid nitrogen to storage) to compensate for changes in the reflux 22. A standard controller may be used to accomplish this adjustment.

The nitrogen content, the rate of change, and the integrated history of nitrogen content in the feed to the crude argon column can be used to select the appropriate oxygen concentration. The selected target value can be obtained by fine adjustmen to the reflux flow.

In operation, if the nitrogen is too high in the crude argon column feed, the correct response is to reduce the reflux. This action alters the operation of the upper column, decreasing the rotative argon content, but more noticeably decreasing the relative nitrogen content of the crude argon column feed, by improving nitrogen stripping above the crude argon column feed withdrawal point. Reversing this action if the nitrogen is too low raises the argon content and the nitrogen content to an acceptable limit.

The concentration of nitrogen in the feedstream to the crude argon column should be monitored and maintained within the range of less than about 10,000 ppm. A suitable range is between about 10 to 7000 ppm and, preferably, between about 100 and 2000 ppm.

A refinement of the control system may be made wherein the response of the RETINA controller may be varied in order to match the nitrogen content to similar changes in the manipulated variable is multiphase in nature. For example, the controller response may be set differently when the nitrogen is below 800 ppm so that the increase in the nitrogen is made slower.

Although a cascade system as mentioned above is preferred, alternate control schemes may be used. For example, a multivariable control scheme may be utilized whereby the relationships of the controller to various factors such as boil-up rate, changes in reflux, etc. is characterized. For example, pulse response analysis may be used to numerically characterize the relationships. Another approach is to use predictive control techniques such as dynamic matrix control. A cascade system, however, is simpler and easier to implement.

Although the reflux flow rate is controlled in the embodiment of FIG. 1, those of ordinary skill in the art will recognize that other control or manipulated variables may be used to maintain optimization other than the reflux. In the event the nitrogen content rises, it is possible to hold back or reduce the argon production. However, this method has the disadvantage of affecting the oxygen concentration in the crude argon product and the argon production rate. Alternatively, the draw or feedstream flow rate into the crude argon column may be controlled as taught by Latimer in U.S. Pat. No. 2,934,908. Another way is to control the oxygen product withdrawal rate. However, this disturbs the original column by a "coupling effect" which can potentially alter the product oxygen and composition and the composition of the overhead stream in conduit 54. The manipulated variables include the variation of the oxygen rich liquid composition in conduit 24 via variation of the nitrogen balance in the lower column 2. The control of the reflux is preferred, since minimal disturbances occur.

Referring in detail to the control system of FIG. 1, the control system comprises first and second analyzers and transmitters (AT1 and AT2) 74 and 76 (also denoted as analyzer means), first and second analyzer recorder-controllers (ARC1 and ARC2) 78 and 80 (also denoted as controller means) and a converter 82 (also denoted as convertor means).

An inlet of analyzer and transmitter 74 is coupled to conduit 46 which connects the upper column 4 to the bottom section of the crude argon column 34. The analyzer and transmitter 74 analyzes (easures) the amount of nitrogen in the conduit 46 and generates an output thereof comprising a current signal whose level is proportional to the percentage nitrogen therein. The output of 74 is coupled to a first input of controller means 78. A first input setpoint or s.p.1 of 78 is coupled to a fixed reference signal which is representative of the desired level of nitrogen to be allowed in the feedstream of conduit 46. This fixed reference signal corresponds to a preselected value at which it is desired to operate the rectification columns during the production operation.

The objective of controller 78 is to maintain the measured signal from analyzer means 74 at the desired setpoint 1. Controller 78 compares the level of nitrogen measured (the output signal of 74) to the setpoint 1, and generates an output signal at the output thereof which is proportional in magnitude to the difference between the two. An increase in the level of nitrogen above the setpoint 1 will cause the output signal of 78 to be higher. This output signal becomes the input signal or setpoint 2 (s.p.2) of controller 80. This causes a reduction in the flow rate of reflux into the upper column 4. This reduces the nitrogen content in the feed to be crude argon column.

Controller 78 is designed to allow operation of the control system in a manual or in an automatic mode of operation via a selector switch. In the manual mode of operation an operator selects and applies a signal level to the setpoint 2 of controller 80. Manual operation is useful during start up of the system or during testing of the system. During normal operation the system is preferably operated in the automatic mode.

An inlet of analyzer and transmitter 76 is coupled to the waste nitrogen stream in conduit 64. The analyzer and transmitter 76 senses (measures) the oxygen content in said stream. At an output thereof it generates a current signal which is proportional to the measured concentration. The output of 76 is coupled to an input of controller means 80. The previously mentioned set point 2 or s.p.2 also inputs into controller means 80. Controller 80 compares this signal s.p.2 and the signal generated by 76 (the measured oxygen) and generates an output signal which is proportional in magnitude to the difference between the two input signals. Convertor means 82 which is typically a current to pressure convertor which in response to a current signal received on the input thereof, generates a force at the output thereof which causes valve 66 to enlarge or contract the size of the opening therein proportionately to the magnitude and direction of the force exerted thereon. This causes the reflux flow rate through valve 66 and into the top of the upper column to increase or decrease.

The mathematical function performed by controller 80 is of the following form:

$$M=G[(r-c)+1/I(r-c)dt+Dd(r-c)/dt]+K$$

where M=the output of 80, G=the proportional gain, c=the first input signal to 80 (the process variable which is the impurity percentage of oxygen), r=the second input signal s.p.2 received from 78, I=an integral action constant, D=the derivative action constant, and K (the bias) is a constant which is the last output if r−c=0 (there is no difference (error) between r and c). The above equation is termed a PID (proportional-integral-derivative) algorithm as will be familiar to those skilled in the art.

In a distillation column, each tray has material and heat capacities. A column with N trays can be considered as a system with 2N interactive capacities in series. A step change in the reflux ratio of a distillation column will quickly effect the composition of the vapor leaving the trays adjacent the reflux as in the use of analyzer means 76, whereas the same column would exhibit a delayed and sluggish "S" shaped change (characteristics of multicapacitance systems) with respect to trays further away from the reflux as in the case of analyzer 74. The further away from the source of input change (reflux), the more delayed and sluggish is the response. Hence, the simple PID algorithm used by controller 80 is not suitable for controller 78. A PID controller would be either weakly tuned during the slower part of the "S" shape or unstable during the rapid part of the "S" shape. As consequence, what is termed a deadbeat PI algorithm is used by controller 80. In such a controller, a deadbeat term is incorporated for use when the controller process variable considerably lags the active process. The mathematical function performed by the controller 78 is of the following form:

$$\Delta M_i = G[(r-c)_i - (r-c)_{i-1} + 1/I\,(r-c)_i dt] - F \sum_{n=1}^{k} \Delta M_{i-n}$$

$M_i$=manipulated variable, the current output of 80
$\Delta$=Change operator (difference between current and last value)
i=Current time interval
dt=Scan interval of the controller
F=deadbeat factor=process deadtime/scan interval
K=interger represents the number of past output values to be considered The deadbeat term accounts for the previous moves made by the manipulated variable. Typically, the number of previous moves is determined by dividing the estimated deadtime by the controller algorithm scan interval.

In a preferred embodiment, controllers 78 and 80 are both implemented by a Texas Instrument PM-550 model programmable logic controller. As will be readily understood by those skilled in the art, the memory of the computer contains instructions in coded form which provide the sequence of control signals described herein.

Figures 2, 2A:
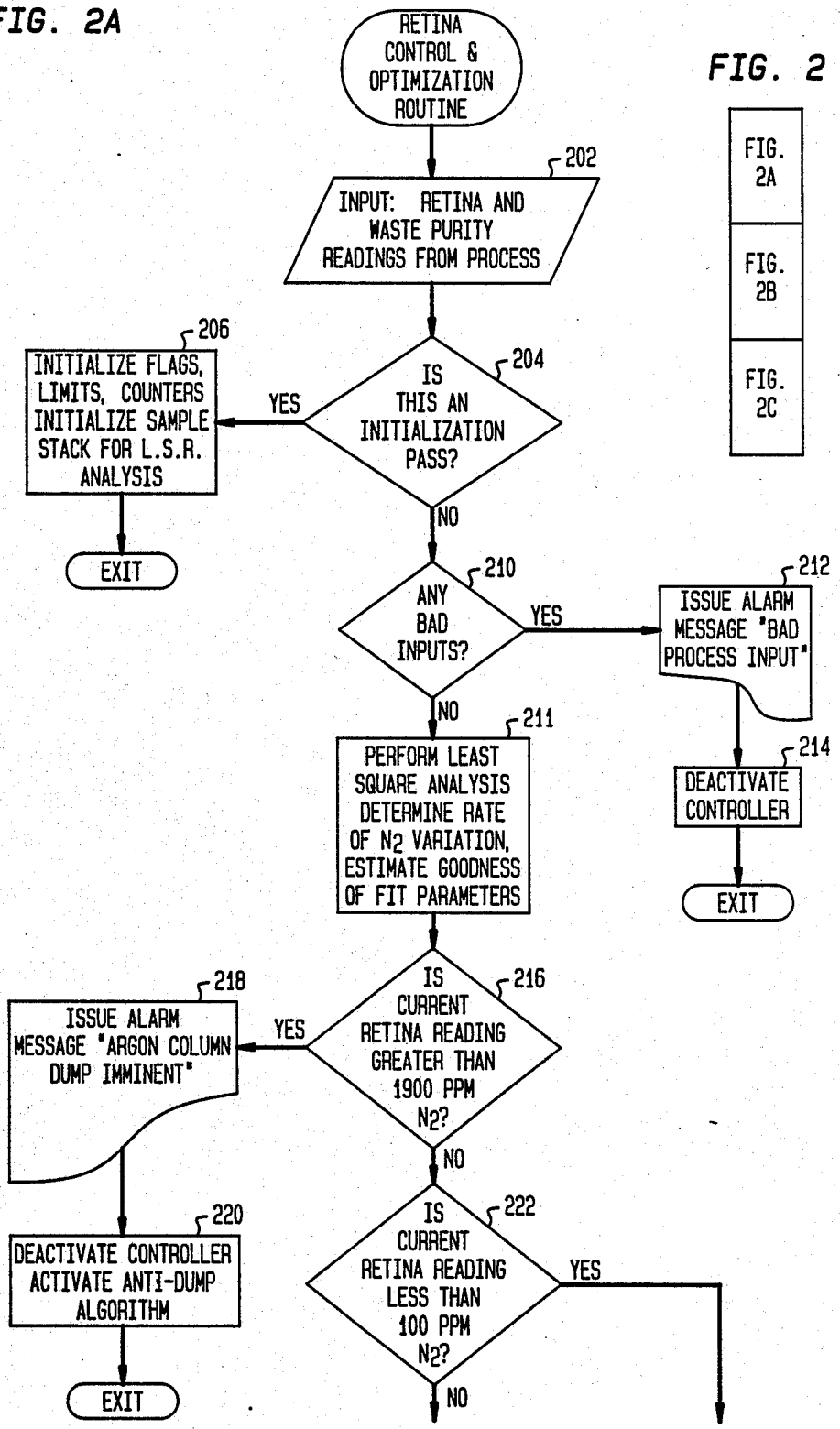
FIG. 2 shows a flow chart illustrating the control function of part of the embodiment of FIG. 1 in accordance with the present invention.
Figure 2B:
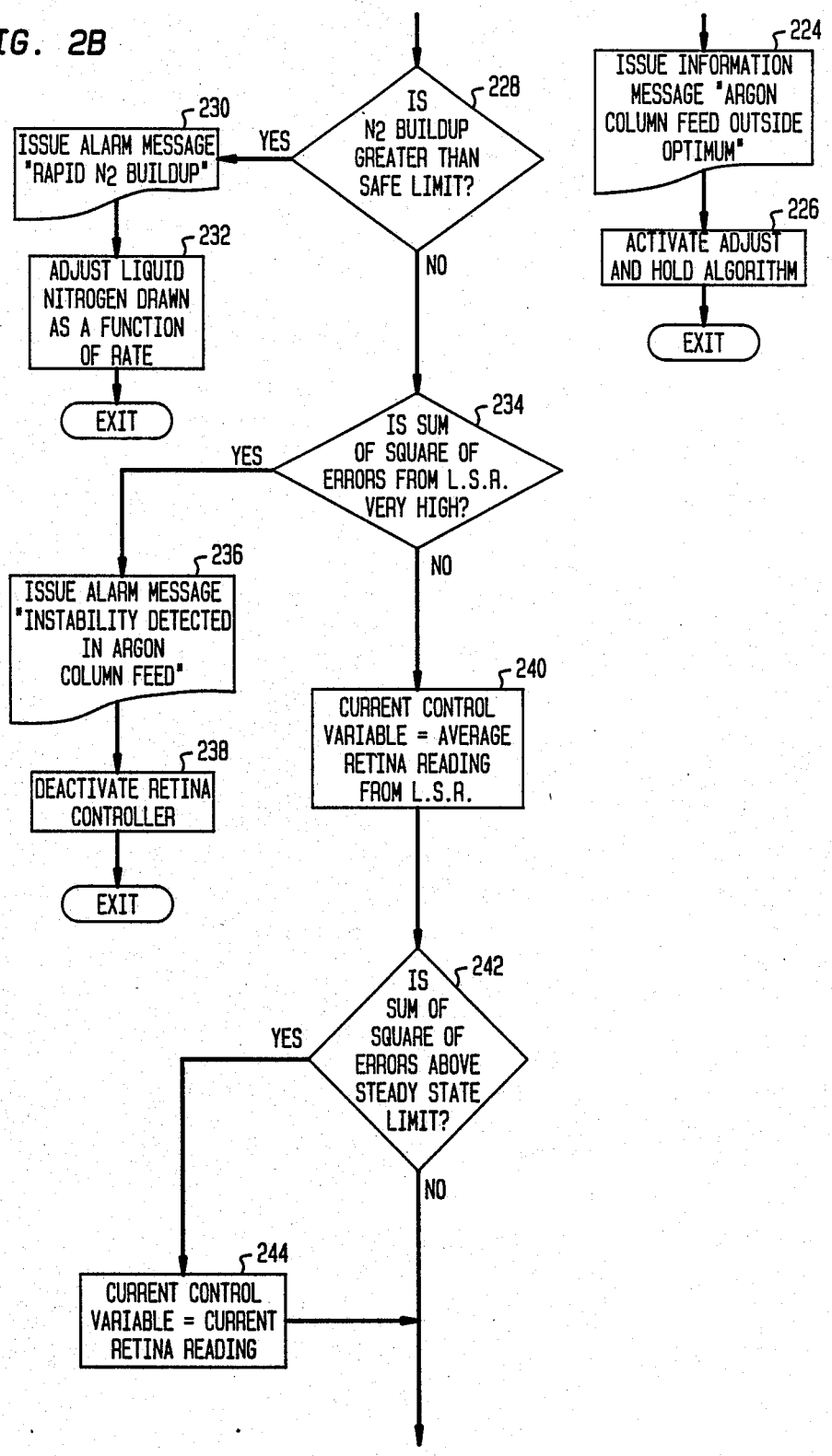
Figure 2C:
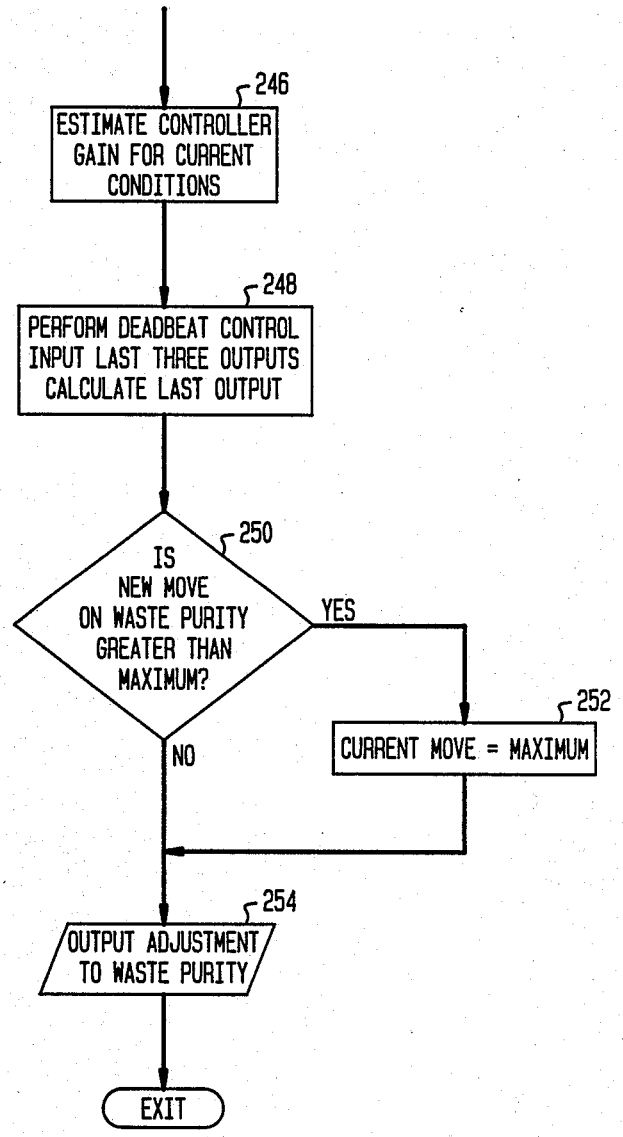

Referring now to the flow diagram of FIG. 2, there is shown a basic operation of the control system of FIG. 1. When the RETINA controller is set to automatic, the control algorithm is triggered and continues to execute at a prespecified scan interval. A suitable scan interval ranges from 1 second to 2 minutes. All input signal levels are scanned and recorded as indicated in block 202. Among the inputs read are the nitrogen content of the crude argon column feedstream and the oxygen content of the nitrogen waste stream.

As denoted in block 204, a determination is then made if this is the first pass. If the answer to the determination in block 204 is YES, then the flags, limits, counters and memory locations are initialized as denoted in block 206. Further, the sample stack for the least squares routine (L.S.R.) analysis is initialized with the current measured nitrogen content in the feed. Subsequently, the program exits for this iteration. On the other hand, if the answer to the determination in block 204 is NO, then as indicated in block 210, a determination is made as to whether there are any bad or out of range process variables or inactive controllers. If the answer to the determination in block 210 is YES, then the system sets off an alarm to the operator and issues a message, as denoted in block 212. Further, as denoted in block 214, the RETINA controller is deactivated. If, on the other hand, the answer to the determination in block 210 is NO, then the control system is fully activated. As denoted in block 211, the controller system performs a least squares analysis (L.S.R.), determines the rate of nitrogen variation and estimates the goodness of fit of the L.S.R. parameters. Thereafter, as denoted in block 216, a determination is then made if the impurity level of nitrogen (the RETINA reading) in the feedstream to the crude argon column is greater than a preselected variable $R_1$. A suitable value for $R_1$ is 1900 ppm, hence, an exemplary determination is whether the nitrogen in the feedstream is greater than 1900 ppm. If the answer to the determination in block 216 is YES, then as denoted in block 218, the system issues an alarm message that an argon column dump is imminent. However, only if the change in pressure $\Delta P$ in the crude argon column drops below a minimum value, as determined by the operator, will anti-dump action be taken. The program subsequently proceeds to block 220, whereby the controller is deactivated and an anti-dump action may be taken by the operator. Such action may consist of stopping the flow in conduit 52, opening valve 42 to purge the non-condensables, and reducing the flow from conduit 48 to a minimum value. Such action could be programmed through an anti-dump algorithm. On the other hand, if the answer to the determination in block 216 is NO, then the program proceeds to block 222, where a determination is made whether the current RETINA reading (nitrogen level) is less than a preselected value $R_2$. A suitable value for $R_2$ is 100 ppm, hence an exemplary determination is whether the nitrogen in the feedstream is less than 100 ppm. If the answer to the determination in block 222 is YES, then as denoted by block 224, the program issues an information message that the argon column feed is outside the optimum and will search and adjust. This algorithm will decrease the waste oxygen content (controller 78 setpoint) a certain amount, await a preselected amount of time, and decrease again until a desired value is achieved. The program then proceeds to block 226, whereby the program activates an adjust and hold algorithm, followed by an exit from the routine. On the other hand, if the answer to the determination in block 222 is NO, i.e., the current RETINA reading is not less than $R_2$ or 100 ppm nitrogen, then the program proceeds to block 228, where a determinaton is made whether the nitrogen build-up is greater than a safe limit, for example, 60 ppm. If the answer to the latter determination is YES, then the program as denoted by block 230 issues an alarm message that there is rapid nitrogen build-up and that the high pressure column product in conduit 18 will be adjusted. Proceeding to block 232, the system adjusts the liquid nitrogen draw as a function of the rate of the nitrogen build-up. This adjustment is a straight forward ratio of the rate of build-up. The specific value is a function of the geometry of the column and interconnecting conduits. On the other hand, if the determination in block 228 is NO, i.e. the nitrogen build-up is not greater than the safe limit, then the program proceeds to block 234, where the determination is made whether the sum of the square of the errors from the least squares routine is very high indicating highly scattered measurements or very rapidly changing values, for example, 200,000 $ppm_2$. However, this determination depends on the scanning interval, the number of values in the L.S.R. stack and the length of time considered. If the answer to the determination in block 234 is YES, then as denoted in block 238, the program issues an alarm message that an instability is detected in the argon column feedstream. Further, the controller is deactivated, as denoted in block 238, followed by an exit for the iteration.

On the other hand, if the answer to the determination in block 234 is NO, i.e. the sum of the square of the errors is not very high, then the program proceeds to block 240, where the current control variable is set to the average RETINA reading from the least square routine. The program proceeds to block 242, where a determination is then made whether the sum of the least square of errors is above the steady state limit, for example, 10,000 ppm which indicates a new transient pattern. If the answer to the latter determination is YES, then proceeding to block 244, the current control variable is set to the current RETINA reading and the program proceeds beyond block 242. In any event, if the answer to the determination of block 242 had been NO, the program would proceed to block 246, where the RETINA controller gain is estimated for current conditions. The program then proceeds to block 248, where the last three RETINA controller moves ΔMv (output changes) discussed earlier in the deadbeat algorithm are inputed into the Deadbeat routine. The current move is outputed. The program proceeds to block 250 where a determination is made whether the new move on the waste purity (the new output to the waste purity setpoint) is greater than the maximum (for example 0.002). If the answer to the latter determination is YES, then the current change in output is first set to the maximum as denoted by block 252, before proceeding to block 254. In any event, if the answer to the determination in block 250 is NO, the program proceeds directly to block 254, where the waste purity adjustment is outputed. The program will then exit from the interation.

The present invention requires an apparatus or sensor 74 for analyzing the composition of an on-line multigas mixture continuously in real time. The multigas mixture comprises oxygen, argon, and nitrogen. Typically, the analyzer will generate a combined spectrum which is not a linear sum of the individual spectra of the component gases. The relative intensities of the spectral lines associated with the individual gases are not preserved due to what is known as the matrix effect. Deconvolution or separation of the individual spectra from a combined spectrum is then necessary.

Despite the complexity of multigas analysis it has been found that for mixtures of argon, nitrogen and oxygen there exists an algebraic relationship, or more properly a family of such relationships, which does accurately and uniquely describe the composition of the multigas mixture over a specific range ofcompositions in terms of specific components of the spectrum from that gas mixture. Such an analytical algorithm can then be embedded in the program memory of a dedicated microcomputer capable of running that algorithm and continually recalculating the gas composition based on spectral data supplied by the optical detector. There then exists a dedicated and real-time gas analyzer.

The mixture of interest for analysis consists of percentage-level argon and oxygen with parts per million (ppm) levels of nitrogen to be monitored and controlled. It is to be noted that the intensity of the nitrogen signal depends not only the nitrogen concentration but also on the argon/oxygen ratio. The very low level of nitrogen means that it is desirable that the analyzer favor the generation of the spectrum associated with nitrogen compared with the more abundant argon and oxygen in the gas.

The present invention therefore utilizes a technique for measuring the composition, or relative concentration, of at least nitrogen of a multicomponent gas mixture comprising nitrogen, argon and oxygen within a more or less specific range of compositions. In particular, the interest is in determining when the nitrogen component falls outside, either above or below a specified range, so to assure that the nitrogen component in the nitrogen, argon and oxygen mixture remains within the desired range.

An analyzer useful in the present invention, which operates by generating a visible emission spectra, is disclosed in copending U.S. application Ser. No. 06/822,457 filed on Jan. 17, 1986 and which is incorporated herein by referenc now abandoned. Such analyzer utilizes circuitry for maintaining a constant current flow through an R.F. (radio frequency) glow discharge reaction which has varying impedance, such as disclosed in U.S. Ser. No. 06/926,279 filed on Nov. 3, 1986 and which is herein incorporated by reference now U.S. Pat. No. 4,719,403. The method of analyzing an emission spectra including the algorithm, for data processing the electrical signals of such spectra is disclosed in copending U.S. application Ser. No. 07/045,336 filed on May 4, 1987, which is herein incorporated by reference.

An analyzer for controlling the feedstream composition of a crude argon column must be capable of continuous real time analysis of nitrogen at a response time of less than 5 minutes. It is therefore evident that automated gas chromatographs are too slow. Analytical devices demonstrating fast multigas analysis capable of use in the present invention include visible emission spectroscopy, laser spectroscopy, and absorption spectroscopy or any other analyzer capable of real time analysis of the relevant gas mixture.

Although the ideal analytical response time is not known, the rates of change of the nitrogen concentration in the crude argon column feedstream have been frequently recorded at in excess of 100 ppm per minute. A suitable time response for the analyzer is under 1 minute. A 0.01 to 15 seconds response time is preferred and a response time of 0.1 second is most preferred. The analyzer must be able to measure ppm levels of nitrogen, as distinguished from percentage levels of argon and nitrogen. In essence, the analyzer is continuous in nature as compared to a batch analyzer such as uses gas chromatography.

EXAMPLE

Figure 3:
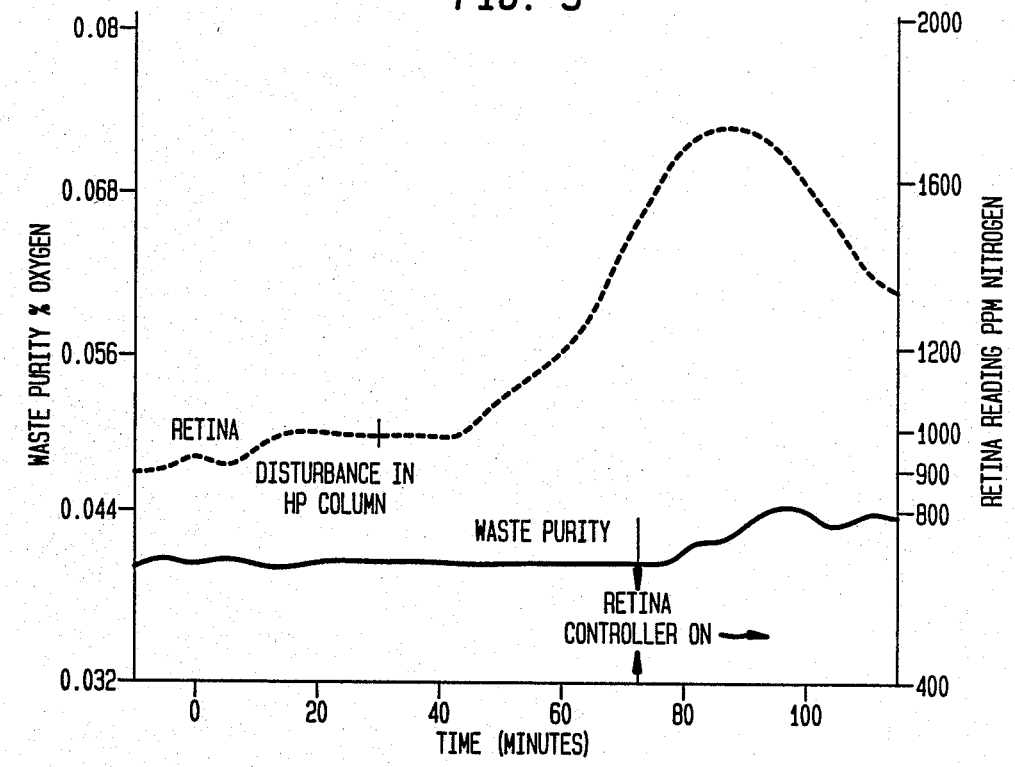
FIG. 3 shows a recorded example of a performance test according to the present invention.

A performance test was conducted whereby a disturbance was created in the high pressure column of an air separation plant in order to influence the nitrogen content in the feed to the crude argon column. The nitrogen content (ppm) in the feed which ran previously between 900 and 1000 ppm increased at a rate of 16 ppm per minute. The RETINA controller was activated 42 minutes later with a nitrogen reading above 1500 ppm. The RETINA controller setpoint was set at 1200 ppm. The controller action resulted in a waste purity change from 0.041% oxygen to 0.044% oxygen, as illustrated in FIG. 3. Six minutes followings controller activation, the nitrogen reading had stabilized at near 1600 ppm and began turning towards the setpoint of 1200 ppm.

It is to be understood that the embodiments described herein are merely illustrative of the general principles of the invention. Various modifications are possible within the general principles of the invention: For example, the comparator-controllers could be formed from hardware components or could be software and another computer than the one denoted. Still further, the sensing and current generating components could be modified to provide output voltage signals instead of output current signals. It will be understood that changes in carrying out the above described embodiment may be made without departing from the principles of the invention.

I claim:

1. A process for separation of air by low temperature rectification capable of producing an oxygen, argon and nitrogen product which comprises: subjecting air to a two-stage rectification wherein a nitrogen rich reflux liquid from a first rectification stage is introduced into a secomd rectification stage to wash the rising vapor at the top poriton of said second rectification stage and withdrawing from a zone of the second rectification stage where the argon content is high, a feedstream which is passed to a crude argon rectification stage, the improvement comprising analyzing in real time the nitrogen content of said feedstream and controlling the operation of said process in response to the results of said analysis.

2. The process of claim 1, wherein in response to the nitrogen content analysis, one or more product withdrawal rates are adjusted.

3. The process of claim 2, wherein in response to the nitrogen content analysis, the oxygen product withdrawal rate is adjusted.

4. The process of claim 2, wherein in response to the nitrogen content analysis, the argon production is adjusted.

5. The process of claim 1, wherein in response to the nitrogen content analysis, the reflux flow rate to the second stage rectification is adjusted.

6. The process of claim 1, additionally including the step of measuring the oxygen content of a waste nitrogen stream produced in said second rectification stage.

7. The process of claim 6, wherein a first controller means is associated with an analyzer means for determining said nitrogen content and a second controller means is associated with an analyzer means for determining the oxygen content of a waste nitrogen stream exiting said second rectification stage and wherein the controllers are cascaded, the first controller being the master controller and the second controller being the slave controller.

8. The process of claim 7, wherein the second controller maintains a predetermined operating line in the low pressure column, said line being determined by the first controller.

9. The process of claim 7, wherein said nitrogen content, the rate of change thereof and an integrated history of the nitrogen content are inputed into said first controller.

10. The process of claim 7, wherein the output of said first controller is used as a set point with respect to said second controller.

11. The process of claim 1, wherein said analysis is utilized to maintain the nitrogen content in the feedstream to the crude argon rectification stage within a preselected range.

12. The process of claim 11, wherein said preselected range is below about 10,000 ppm.

13. The process of claim 12, wherein said preselected range is between 10 and 7000 ppm.

14. The process of claim 13, wherein said preselected range is between about 100 to 2000 ppm.

15. The process of claim 1, wherein the nitrogen content is determined by a real time analyzer means selected from the group consisting of visible emission spectroscopy, laser spectroscopy and absorption spectroscopy.

16. The process of claim 15, wherein the nitrogen content is determined by visible emission spectroscopy.

17. The process of claim 15, wherein the response time of the analyzer is under about 5 minutes.

18. The process of claim 7, wherein the response time is under about 1 minute.

19. The process of claim 18, wherein the response time is 0.01 to 15 seconds.

20. The process of claim 1, additionally including the step of determining the argon and oxygen content of the feedstream.

21. The process of claim 1, wherein the second rectification stage is controlled by adjusting the reflux ratio thereto.

22. The process of claim 1, wherein an oxygen and a nitrogen product are formed.

23. The method of claim 1, wherein said feedstream is comprised mainly of oxygen and argon.

24. The process of claim 1, wherein in response to the nitrogen content analysis, the feedstream flow rate is adjusted.

25. A system for controlling the separation of air by low temperature rectification to obtain argon and at least one of oxygen and nitrogen wherein air is subjected to a two-stage rectification in which a nitrogen rich reflux fluid is passed from a first rectification column to a second rectification column for washing the rising vapor of the said second rectification column and wherien a sidestream is withdrawn from said second rectification column and introduced for further rectification into a third column for the production of crude argon comprising:

(i) a first analyzer means for on-line sensing in real time of the nitrogen content of said sidestream passing from said second rectification column to said third column; and (ii) a second analyzer means for sensing the oxygen content of a waste nitrogen stream of said second rectification column; and (iii) a means for controlling the operating line of the second rectification column, based on the inputs of said first and second analyzer means, by controlling the reflux flow of nitrogen rich fluid from said first rectification column to said second rectification column.

26. The system of claim 25, wherein the response time of the analyzer means is under about 5 minutes.

27. The system of claim 25, wherein the response time is under about 1 minute.

28. The system of claim 25, wherein the response time is 0.01 to 15 seconds.

29. The system of claim 25, wherein said controller means comprises a first controller means associated with said first analyzer means and a second controller means associated with said second analyzer means, said controller means being cascaded, the first controller means being primary and the second controller means being secondary.

30. The system of claim 29, wherein said second controller means is adapted to maintain a predetermined operating line in the low pressure column, said line being determined by the first controller means.

31. The system of claim 25, further comprising a means for adjusting an additional operating parameter of said air separation process based on the inputs of said first and second analyzer.

32. The system of claim 31, further comprising a means for adjusting a product withdrawal rate.

* * * * *